US010999691B2

(12) United States Patent
Wang

(10) Patent No.: US 10,999,691 B2
(45) Date of Patent: May 4, 2021

(54) METHOD FOR ACQUIRING SPATIAL DIVISION INFORMATION, APPARATUS FOR ACQUIRING SPATIAL DIVISION INFORMATION, AND STORAGE MEDIUM

(71) Applicant: Beijing Xiaomi Intelligent Technology Co., Ltd., Beijing (CN)

(72) Inventor: Zhao Wang, Beijing (CN)

(73) Assignee: Beijing Xiaomi Intelligent Technology Co., Ltd., Beijing (CN)

( * ) Notice: Subject to any disclaimer, the term of this patent is extended or adjusted under 35 U.S.C. 154(b) by 0 days.

(21) Appl. No.: 16/695,699

(22) Filed: Nov. 26, 2019

(65) Prior Publication Data

US 2020/0351604 A1 Nov. 5, 2020

(30) Foreign Application Priority Data

Apr. 30, 2019 (CN) ..... 201910363989.5

(51) Int. Cl.
*H04S 7/00* (2006.01)
*H04R 1/40* (2006.01)
(Continued)

(52) U.S. Cl.
CPC ..... *H04S 7/301* (2013.01); *H04R 1/406* (2013.01); *H04R 3/005* (2013.01); *H04R 5/02* (2013.01);
(Continued)

(58) Field of Classification Search
CPC ..... H04S 7/301; H04S 3/008; H04S 7/303; H04S 7/305; H04S 2400/01;
(Continued)

(56) References Cited

U.S. PATENT DOCUMENTS 9,769,424 B2 * 9/2017 Michot ..... G06K 9/00335
2004/0240680 A1 12/2004 Rui et al.
(Continued)

FOREIGN PATENT DOCUMENTS

CN 108028955 A 5/2018
KR 10-2018-0038326 A 4/2018
WO WO 2011/145030 A1 11/2011

OTHER PUBLICATIONS

Chung et al., Translation of KR20180038326A, Apr. 16, 2018 (Year: 2018).*
(Continued)

*Primary Examiner* — Regina N Holder
(74) *Attorney, Agent, or Firm* — Oblon, McClelland, Maier & Neustadt, L.L.P.

(57) ABSTRACT

The disclosure relates to a method and apparatus for acquiring spatial division information. The method includes controlling a sound source device to play a first sound signal; obtaining a second sound signal that is a sound signal collected by a sound collecting device when the first sound signal is propagated to the sound collecting device; obtaining direct intensity information based on the second sound signal, wherein the direct intensity information indicates an intensity of a direct sound signal in the second sound signal, wherein the direct sound signal is a sound signal that is generated by the sound source device and reaches the sound collecting device without physical reflection; and obtaining spatial division information based on the direct intensity information, wherein the spatial division information indicates whether the sound source device and the sound collecting device are in a same spatial zone.

18 Claims, 5 Drawing Sheets

(51) Int. Cl.

| | |
|---|---|
| ***H04S 3/00*** | (2006.01) |
| ***H04R 3/00*** | (2006.01) |
| ***H04R 5/02*** | (2006.01) |
| ***H04R 5/04*** | (2006.01) |

(52) U.S. Cl.
CPC ..... *H04R 5/04* (2013.01); *H04S 3/008* (2013.01); *H04S 7/303* (2013.01); *H04S 7/305* (2013.01); *H04S 2400/01* (2013.01); *H04S 2400/15* (2013.01)

(58) Field of Classification Search
CPC ..... H04S 2400/15; H04R 1/406; H04R 3/005; H04R 5/02; H04R 5/04
See application file for complete search history.

(56) References Cited

U.S. PATENT DOCUMENTS

| | | | |
|---|---|---|---|
| 2006/0215850 | A1 | 9/2006 | Rui et al. |
| 2006/0227977 | A1 | 10/2006 | Rui et al. |
| 2012/0327746 | A1 | 12/2012 | Velusamy |
| 2013/0064042 | A1 | 3/2013 | Aarts et al. |
| 2019/0081810 | A1 | 3/2019 | Jung |

OTHER PUBLICATIONS

Extended European Search Report dated Apr. 14, 2020 in European Patent Application No. 19217171.8, 6 pages.
Combined Chinese Office Action and Search Report dated Jul. 21, 2020 in Chinese Patent Application No. 201910363989.5, 7 pages.
Hioka, Y., et al., "Estimating Direct-to-Reverberant Energy Ratio Using D/R Spatial Correlation Matrix Model", IEEE Transactions on Audio, Speech, and Language Processing, vol. 19, No. 8, Nov. 2011, pp. 2374-2384 with cover page.

* cited by examiner

METHOD FOR ACQUIRING SPATIAL DIVISION INFORMATION, APPARATUS FOR ACQUIRING SPATIAL DIVISION INFORMATION, AND STORAGE MEDIUM

CROSS-REFERENCE TO RELATED APPLICATIONS

This application is based on and claims priority to Chinese Patent Application No. 201910363989.5, filed on Apr. 30, 2019, the entire contents of which are incorporated herein by reference.

TECHNICAL FIELD

The present disclosure relates to the field of smart home devices, and more particularly, to a method for acquiring spatial division information, an apparatus for acquiring spatial division information, and a storage medium.

BACKGROUND

With the continuous development of artificial intelligence technology, there are more and more applications in smart home devices. In the home environment of people's daily life, it is also very common to place multiple voice-enabled smart home devices to improve the voice playing effect.

In the related art, the space in which the devices are actually placed can be divided. For example, a sound signal may be played to the space through a smart home device, and a received sound signal may be sensed by its own receiver to determine a room impulse response (RIR) of the space, and a reverberation time of the room through the RIR. The area size of the space where the smart home device is placed may be inversely calculated according to the reverberation time of the room, and respective area sizes calculated by the different smart home devices may be compared with each other, thereby determining whether different smart home devices are placed in the same area.

SUMMARY

This Summary is provided to introduce a selection of aspects of the present disclosure in a simplified form that are further described below in the Detailed Description. This Summary is not intended to identify key features or essential features of the claimed subject matter, nor is it intended to be used to limit the scope of the claimed subject matter.

Aspects of the disclosure provide a method for acquiring spatial division information. The method includes controlling a sound source device to play a first sound signal; obtaining a second sound signal that is a sound signal collected by a sound collecting device when the first sound signal is propagated to the sound collecting device; obtaining direct intensity information based on the second sound signal, wherein the direct intensity information indicates an intensity of a direct sound signal in the second sound signal, wherein the direct sound signal is a sound signal that is generated by the sound source device and reaches the sound collecting device without physical reflection; and obtaining spatial division information based on the direct intensity information, wherein the spatial division information indicates whether the sound source device and the sound collecting device are in a same spatial zone.

According to an aspect, the second sound signal is a sound signal collected by a microphone array in the sound collection device, wherein the microphone array includes at least two microphones, and when obtaining the direct intensity information based on the second sound signal, the method further includes obtaining spatial distribution information that indicates a spatial distribution relationship between the at least two microphones; obtaining a spatial correlation matrix of the second sound signal based on the spatial distribution information; and obtaining the direct intensity information based on the spatial correlation matrix and the second sound signal.

According to another aspect, when obtaining the spatial distribution information, the method further includes constructing a spatial coordinate system including the at least two microphones; obtaining respective spatial coordinates of the at least two microphones in the spatial coordinate system; and obtaining the spatial distribution information including respective spatial coordinates of the at least two microphones in the spatial coordinate system.

According to yet another aspect, when obtaining the spatial correlation matrix of the second sound signal based on the spatial distribution information, the method further includes obtaining a direct angle that is an angle between a line connecting the source of the first sound signal and an origin of the spatial coordinate system and a first coordinate axis that is any one of the coordinate axes of the spatial coordinate system; and obtaining a spatial correlation matrix of the second sound signal based on the direct angle and the coordinates of the at least two microphones in the spatial coordinate system respectively.

According to yet another aspect, when obtaining the direct intensity information based on the spatial correlation matrix and the second sound signal, the method further includes formulating a target equation based on the spatial correlation matrix and the second sound signal, wherein variants in the target equation are the direct sound signal and a reverberation sound signal that is a sound signal that is generated by the sound source and reaches the sound collecting device through physical reflection; and obtaining the direct intensity information through calculating a pseudo-inverse by a least-square method.

According to yet another aspect, when obtaining the spatial distribution information based on the direct intensity information, the method further includes acquiring the spatial division information based on size relation between the direct signal intensity and a signal intensity threshold.

According to yet another aspect, before acquiring the spatial division information based on the size relation between the direct signal intensity and the signal intensity threshold, the method further includes obtaining a signal intensity of the first sound signal; and obtaining a signal intensity threshold based on the signal intensity of the first sound signal.

According to yet another aspect, when obtaining the spatial distribution information based on the direct intensity information, the method further includes acquiring the spatial division information based on size relation between the direct signal intensity and a signal intensity threshold.

Aspects of the disclosure also provide an apparatus for acquiring spatial division information. The apparatus includes a processor and a memory configured to store processor executable instructions. The processor is configured to control a sound source device to play a first sound signal; obtain a second sound signal that is a sound signal collected by a sound collecting device when the first sound signal is propagated to the sound collecting device; obtain direct intensity information based on the second sound signal, wherein the direct intensity information indicates an intensity of a direct sound signal in the second sound signal, wherein the direct sound signal is a sound signal that is generated by the sound source device and reaches the sound collecting device without physical reflection; and obtain spatial division information based on the direct intensity information, wherein the spatial division information indicates whether the sound source device and the sound collecting device are in a same spatial zone.

It is to be understood that both the foregoing general description and the following detailed description are illustrative and explanatory only and are not restrictive of the present disclosure.

BRIEF DESCRIPTION OF THE DRAWINGS

The accompanying drawings, which are incorporated in and constitute a part of the description, illustrates aspects in consistent with the present disclosure and, together with the description, serve to explain the principles of the present disclosure.

The specific aspects of the present disclosure, which have been illustrated by the accompanying drawings described above, will be described in detail below. These accompanying drawings and description are not intended to limit the scope of the present disclosure in any manner, but to explain the concept of the present disclosure to those skilled in the art via referencing specific aspects.

DETAILED DESCRIPTION

Reference will now be made in detail to exemplary aspects, examples of which are illustrated in the accompanying drawings. The following description refers to the accompanying drawings in which the same numbers in different drawings represent the same or similar elements unless otherwise represented. The implementations set forth in the following description of illustrative aspects do not represent all implementations consistent with the disclosure. Instead, they are merely examples of apparatuses and methods consistent with aspects related to the disclosure as recited in the appended claims.

Application scenarios for smart home devices described in the aspects of the present disclosure is for the purpose of illustrating the technical solutions of the aspects of the present disclosure, and does not constitute a limit to the technical solutions provided by the aspects of the present disclosure. And one of ordinary skill in the art can learn that, with emergence of new smart home device, the technical solutions provided by the aspects of the present disclosure are equally applicable to similar technical problems.

For purpose of easy understanding, some terms and application scenarios involved in the aspects of the present application are briefly introduced below.

Room Impulse Response (RIR): In room acoustics, an impulse response function of a system pulse in a room is called a room impulse response. For the same room, the impulse response from the source to the receiving point is unique and contains all the acoustic properties of the indoor sound field.

Direct Sound: A sound signal that is sent from the sound source and reaches the receiving point without any reflection.

Early Reflections: A sound signal that is sent from the sound source and reaches the receiving point after one or two reflections by the wall, the ceiling or the floor of the room. Generally, the reflected sounds that reach the receiving point later than the direct sound by less than 50 ms (milliseconds) are all early reflections.

Reverberation: A sound that is emitted from a sound source and reaches the receiving point more than 50 ms later than the direct sound after multiple reflections is called a reverberation sound.

Reverberation Time: refers to a time required for the sound energy density of the emitted sound signal to decrease to 1/(10^6) of the sound energy density of the sound signal emitted from the sound source after the sound source stops sounding, or, a time for the sound pressure level of the emitted sound signal to attenuate by 60 dB.

Figure 1:
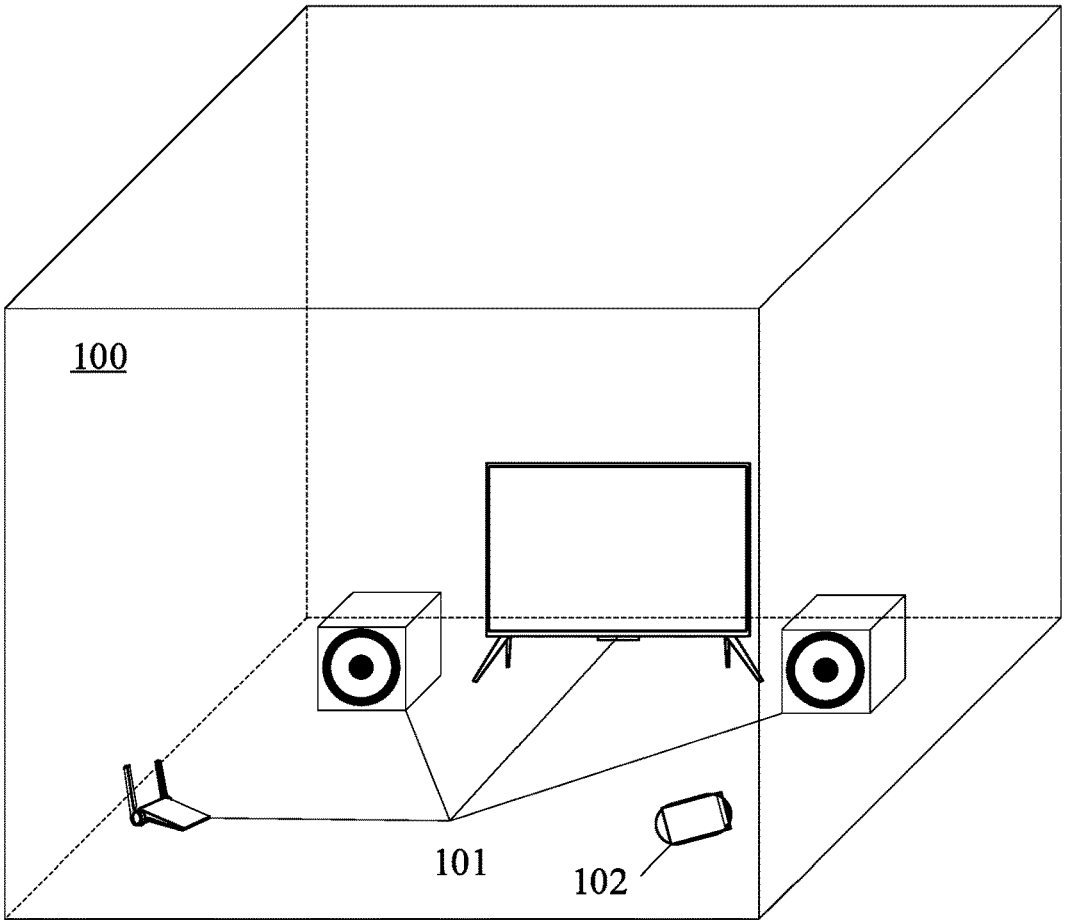
FIG. 1 is a schematic diagram illustrating a spatial layout of an application scenario of a smart home device according to an exemplary aspect of the present disclosure.

FIG. 1 is a schematic diagram illustrating a spatial layout of an application scenario for smart home devices according to an aspect of the present disclosure. As illustrated in FIG. 1, there are multiple smart home devices 101 in a room 100.

Among them, the smart home device 101 is a home device having a sound emitting function and/or a sound collecting function. For example, the smart home device 101 can comprise, but is not limited to, a fixed installation or a small range of mobile devices, such as a smart TV, an intelligent robot, a smart speaker, a smart refrigerator, a smart air conditioner, a smart rice cooker, a smart sensor (such as an infrared sensor, a light sensor, a vibration sensor, a sound sensor, etc.), and a smart water purification device. Alternatively, the smart home device 101 can be a mobile device, such as MP3 player (Moving Picture Experts Group Audio Layer III), MP4 (Moving Picture Experts Group Audio Layer IV), Mobile devices such as players and smart Bluetooth headsets.

Optionally, smart home devices can also be connected to each other through a wired network or a wireless network. Alternatively, the wireless network or the wired network is based on standard communication technologies and/or protocols. The network is usually the Internet, but can also be any kind of networks, comprising but not limited to a Local Area Network (LAN), a Metropolitan Area Network (MAN), a Wide Area Network (MAN), a mobile network, a wired or a wireless network, private networks or virtual private networks, or any combination thereof. In some aspects, data exchanged over network is represented using techniques and/or formats comprising Hyper Text Markup Language (HTML), Extensible Markup Language (XML), and the like. In addition, Regular encryption techniques, such as Secure Socket Layer (SSL), Transport Layer Security (TLS), Virtual Private Network (VPN), and Internet Protocol Security (IPsec), are used to encrypt all or some of the links. In other aspects, the above described data communication techniques may also be replaced or supplemented by custom and/or dedicated data communication techniques.

Optionally, there are one or more control devices 102 in the room 100, and the control device 102 may be connected to the smart home device 101 through the wired network or the wireless network, and the user may control the control device 102 to make corresponding smart home devices perform corresponding operations. Optionally, the control device 102 can be a smart terminal. Optionally, the smart terminal can be a smart phone, a tablet, an e-book reader, smart glasses, a smart watch, and the like. For example, the user can control the device A among the smart home devices to send data or a signal to the device B through a smart phone, or the user controls the temperature of the smart refrigerator among the smart home device through a smart phone.

In one possible aspect, one or more devices among the smart home device 101 may also be configured as the control device 102.

In the related art, when rooms division is required for the smart home devices, size of respective space where respective smart home devices are located can be calculated by the respective smart home devices, for example, this can be done through a voice-based decision method. For example, in a room, when the smart home device acts as a sound source and sends out a sound signals, the receiving end of the smart home device can receive the sound signals emitted by itself. The sound signals received by the receiving end of the smart home device comprises not only sound signals that is sent by the sound source and is directly propagated to the receiving end, but also the sound signal that is sent by the smart home device itself and is reflected the wall and the ceiling of the room and other articles (reflected sound). The sound signals received by the receiving end of the smart home device are a combination of the direct sound and the reflected sound of the sound signals that is sent by the smart home device. The reflected sound can reflect the size and the reflection characteristics of the room where the smart home device is located, wherein the reflection characteristic of the room generally does not change, that is, the sound signals received by the receiving end can be regarded as a sound signal that is obtained by convoluting the direct sound signal with the RIR of the room. Thus, further, the reverberation time of the room can be obtained through obtaining the RIR of the room, and in turn, size of zone of the space where the smart home device is located can be inversely derived from the reverberation time of the room, thereby dividing itself into the calculated size of the spatial zone.

In a possible aspect, the relationship between the sound signal that is sent by the sending end and is receiving by the receiving end of the smart home device and the room impulse response can be expressed as that shown in the formula [1]:

$$h(k)=Ry(k)=W[y(n)y^*(n-k)]; \quad [1]$$

Where h(k) is the time domain representation of the room impulse response, k is the offset in the time domain; Ry(k) is the autocorrelation function of the sound signal that is sent by the receiving end of the smart home device and received by the receiving end of the smart home device; W representing the normalized energy of the received signal; y(n) is the sound signal sent by the sending end that is received by the receiving end of the smart home device, and n is the n-th time of playing the sound signal at this time;

In the smart home device, the above formula [1] can be obtained according to the received sound signal, and then, the received sound signal is deconvoluted, and a curve expression of the normalized energy W can be obtained, as shown in the formula [2]:

$$W(t) = G\int_t^{\infty} h^2(k)dk; \quad [2]$$

Where G is a constant and t is the time of corresponding received sound signal. The equation indicates that the normalized energy W is an integral of the square of the RIR on continuous time. Optionally, if the normalized energy W is expressed by discrete time points, it can be expressed as:

$$W(t) = \sum_t^{\infty} h^2(k)$$

Figure 2:
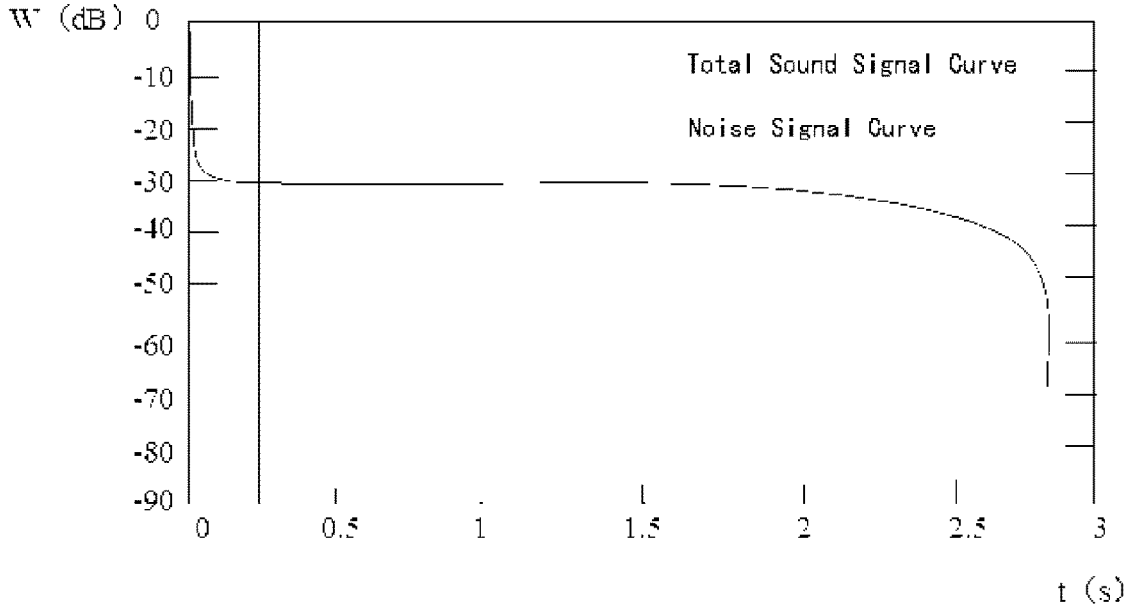
FIG. 2 is a schematic diagram of a sound signal energy over time based on the formula [2] according to an exemplary aspect of the present disclosure.

The smart home device can further obtain intensities of the sound signals received at each time point through the above formula [2]. FIG. 2 is a schematic diagram illustrating change of a sound signal energy over time based on the formula [2] according to an aspect of the present disclosure. As illustrated in FIG. 2, the horizontal axis represents time t(s), and the vertical axis represents normalized energy W (dB), that is, corresponding to the received sound signal intensity.

In general, developers can set the attenuation range of normalized energy in smart home devices according to experience, so that the smart home devices can select and determine the normalized energy data so as to calculate the room reverberation time. For example, statistics on intensity attenuation time of the received sound signals in a range of [−5 dB, −35 dB] is conducted, thereby further obtaining the corresponding room reverberation time, and inversely calculating the size of the room. Subsequently, room sizes that are respectively calculated by different smart home devices are compared and smart home devices with same or similar room size are divided into a same space zone, thereby completing the spatial division for the smart home devices.

In the related art, a smart home device is used to collect sound signals played by itself, in this process, the smart home device collects the sound signal played by itself to calculate the RIR value in the room, derives the size of the room, and then the room sizes obtained by different smart home device are compared, and it is determined that the different smart home device are in the same room zone, thereby conducting spatial division for the smart home device. If room sizes that are calculated by smart home devices placed in different rooms are close to each other, or if RIR of different rooms are close to each other, smart home devices placed in different rooms may be divided into a same spatial zone, thereby causing less accuracy of spatial division.

In the technical solution provided by the present disclosure, for the application scenarios of the smart home devices, a first sound signal is played by a sound source device, and a sound collecting device collects a second sound signal to obtain a direct sound signal in the second sound signal, which is taken as a basis of spatial division for smart home devices, so as to improve the accuracy of spatial division for smart home devices. Hereinafter, the technical solutions provided by the present disclosure will be described by way of several aspects.

Figure 3:
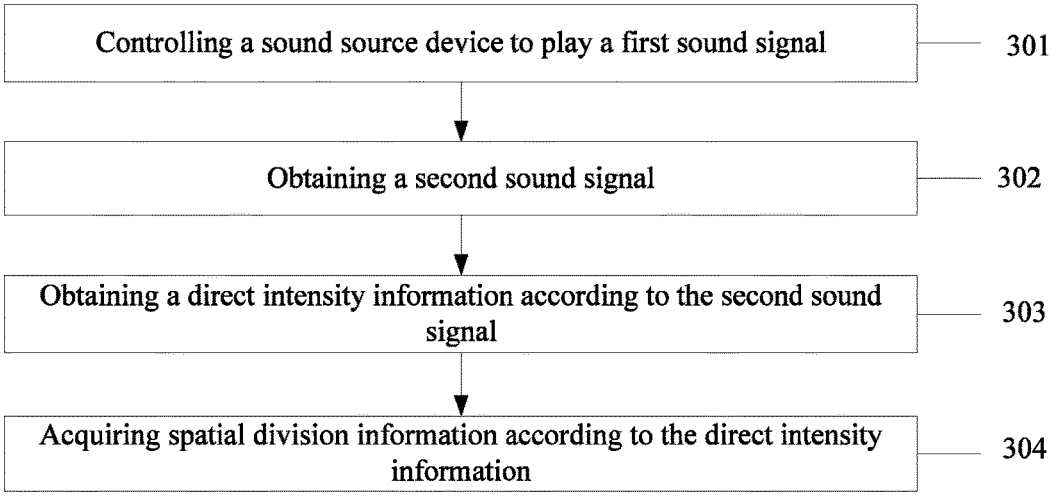
FIG. 3 is a flowchart of a spatial division information acquiring method illustrated according to one exemplary aspect of the present disclosure.

FIG. 3 is a flowchart of a spatial division information acquiring method illustrated according to one exemplary aspect of the present disclosure. The method can be applicable to the application scenario of the smart home device illustrated in FIG. 1. The method can comprise the following steps:

In step 301, a sound source device is controlled to play a first sound signal;

In step 302, a second sound signal is obtained.

Wherein the second sound signal is a sound signal collected by a sound collecting device when the first sound signal is propagated to the sound collecting device;

In step 303, a direct intensity information is obtained according to the second sound signal.

Wherein, the direct intensity information is used to indicate an intensity of a direct sound signal in the second sound signal; the direct sound signal is a sound signal that is sent by the sound source device and is and reaches the sound collecting device without physical reflection;

In step 304, spatial division information is acquired according to the direct intensity information, where the spatial division information is used to indicate whether the sound source device and the sound collecting device are in a same spatial zone.

Optionally, the second sound signal is a sound signal collected by a microphone array in the sound collection device, and the microphone array comprises at least two microphones;

Obtaining the direct intensity information according to the second sound signal comprises:

obtaining spatial distribution information, wherein the spatial distribution information is used to indicate a spatial distribution relationship between the at least two microphones;

obtaining a spatial correlation matrix of the second sound signal according to the spatial distribution information; and obtaining the direct intensity information according to the spatial correlation matrix and the second sound signal.

Optionally, obtaining the spatial distribution information comprises:

constructing a spatial coordinate system comprising the at least two microphones;

obtaining respective spatial coordinates of the at least two microphones in the spatial coordinate system; and obtaining the spatial distribution information comprising respective spatial coordinates of the at least two microphones in the spatial coordinate system.

Optionally, obtaining the spatial correlation matrix of the second sound signal according to the spatial distribution information comprises:

obtaining a direct angle, wherein the direct angle is an angle between a line connecting a sending source of the first sound signal and an origin of the spatial coordinate system and a first coordinate axis, and the first coordinate axis is any one of coordinate axes of the spatial coordinate system; and obtaining the spatial correlation matrix of the microphone array according to the direct angle and the respective ordinates of the at least two microphones in the spatial coordinate system.

Optionally, obtaining the direct intensity information according to the spatial correlation matrix and the second sound signal comprises:

formulating a target equation according to the spatial correlation matrix and the second sound signal, wherein variants in the target equation are the direct sound signal and a reverberation sound signal, and the reverberation sound signal is a sound signal that is sent by the sound source and reaches the sound collecting device through physical reflection; and obtaining the direct intensity information through calculating a pseudo-inverse from the target equation through a least-square method.

Optionally, acquiring the spatial division information according to the direct intensity information comprises:

acquiring the spatial division information according to size relation between the direct signal intensity and a signal intensity threshold.

Optionally, before acquiring the spatial division information according to the size relation between the direct signal intensity and a signal intensity threshold, the method further comprises:

obtaining a signal intensity of the first sound signal; and obtaining the signal intensity threshold according to the signal intensity of the first sound signal.

As described above, by controlling the sound source device to play the first sound signal, obtaining the sound signal collected by the sound collecting device, and completing spatial division for the sound source device and the sound collecting device according to the direct intensity information in the collected sound signal, because whether the sound source device and the sound collection device is in the same spatial zone (such as whether it is the same room) has a great influence on the intensity of the direct sound signal emitted by the sound source device, and therefore, it can be easily determined through the direct intensity information whether the two sound source devices and the sound collection device are in the same spatial zone, thereby improving the accuracy of spatial division for the smart home devices.

Figure 4:
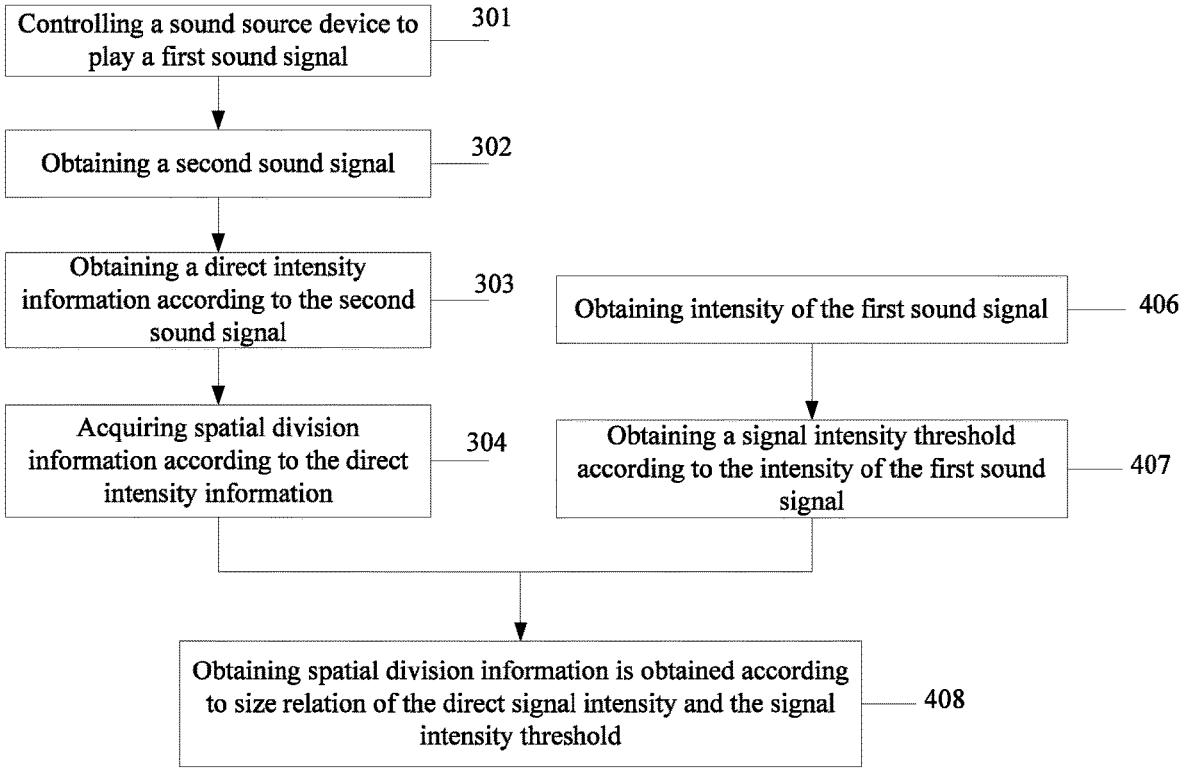
FIG. 4 is a flowchart of a spatial division information acquiring method illustrated according to one exemplary aspect of the present disclosure.

FIG. 4 is a flowchart of a spatial division information acquiring method illustrated according to one exemplary aspect of the present disclosure. The method can be applicable to the application scenario of the smart home device illustrated in FIG. 1. The method can be performed by a control device, and can comprise the following steps:

In step 401, a sound source device is controlled to play a first sound signal;

When a control device performs spatial division for a sound source device and a sound collecting device so as to determine whether the two devices are in a same spatial zone (such as a same room), the control device can control the sound source device to play the first sound signal. Optionally, the smart home device can be the control device in the application scenario illustrated in FIG. 1 above. The first sound signal can be a song, a sound recording, a broadcast, and the like. For example, a user can control a smart speaker to play a song through a smart phone, or turn on a smart broadcast to play a broadcast.

In step 402, a second sound signal is obtained, wherein the second sound signal is a sound signal collected by a sound collecting device when the first sound signal is propagated to the sound collecting device.

In the application scenarios of the smart home device, the sound collection device with a sound collection function can collect the first sound signal played by the sound source device. where the sound source plays the first sound signal, sound signals received by the sound collecting devices are the first sound signals that are directly propagated to the sound collecting device and sound signals reaches the sound collecting device after reflections by articles in the space, that is, the second sound signal collected by the sound collecting device comprise not only sound signals that is directly propagated to the sound collecting device (i.e., without reflections) but also sound signals that reaches the sound collecting device after reflections by the articles in the space (i.e., physical reflections). Optionally, the article that reflects the first sound signal may be a wall, a ceiling, a ground in a space, and other smart home devices in the room. Optionally, the sound collecting device can further be a smart speaker.

Optionally, the sound collection device can send the collected second sound signal to the control device, so that the control device obtains the second sound signal. For example, the control device may be a device independent of the sound collection device and the sound source device, such as a smart terminal, an intelligent router, or a server; or the control device may further be a sound source device.

Optionally, the foregoing control device can further be a sound collection device, that is, the control device obtain the second sound signal through a built-in sound collection component (such as a microphone component).

Optionally, the first sound signal played by the sound source device is collected by the sound collecting device through spatial propagation. A relationship between the second sound signal collected by the sound collecting device and the first sound signal played by the sound source device can be represented as a function expression in a time domain or a function expression in a frequency domain. For example, taking the function expression in frequency domain between the first sound signal and the second sound signal as an example, the second sound signal collected by the sound collecting device can be represented by a space transfer function $H(\omega)$, wherein the spatial transfer function $H(\omega)$ in frequency domain can be decomposed into two parts, a direct component function $H_D(\omega)$ and a reverberation component function $H_R(\omega)$, wherein the direct component function $H_D(\omega)$ is a function corresponding to sound signals that are sent by the sound source device and reach the sound collecting device without physical reflections, and the reverberation component function $H_R(\omega)$ is a function corresponding to sound signals that are sent by the sound source device and reach the sound collecting device after physical reflection. Optionally, sound signal of the early reverberation component can also be represented in the reverberation component function $H_R(\omega)$. Alternatively, as illustrated in FIG. 2 above, the sound signal of the early reverberation component can be the sound signal contained in $t_1$ to $t_2$. Alternatively, $t_1$ to $t_2$ can be set by the developer in the sound source collecting device in advance. wherein $\omega$ is a frequency of the first sound signal played by the sound source device.

Figure 5:
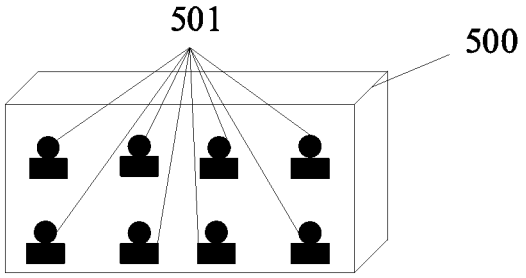
FIG. 5 is a schematic structural diagram of a sound collecting device related to an exemplary aspect of the present disclosure.

Optionally, the sound collecting device can collect sound signals through its own microphone. For example, the sound collecting device can have a microphone array, and the microphone array comprises at least two microphones. Please refer to FIG. 5, which illustrates a schematic structural diagram of a sound collecting device according to an aspect of the present disclosure. As illustrated in FIG. 5, the sound collecting device comprises a plurality of microphones 501 which constitute a microphone array. Optionally, the sound collecting device can collect the first sound signal that is sent by the sound source device through the plurality of microphones and can superimpose sound signals collected by the plurality microphones so as to obtain the second sound signal. For example, for a sound collecting device having a microphone array with M microphones, sound signal received by the m-th microphone can be expressed by the formula [3] as:

$$X^{(m)}(\omega,t)=[H_D^{(m)}(\omega,t)+H_R^{(m)}(\omega,t)]*S(\omega,t); \quad [3]$$

Wherein $X(m)(\omega, t)$ is the sound signal collected by the m-th microphone, $H_D(m)(\omega, t)$ is a direct component function corresponding to the sound signal collected by the m-th microphone, $H_R(m)(\omega, t)$ is a reverberation component function corresponding to the sound signal collected by the m-th microphone, and t is a time corresponding to the first sound signal played by the sound source device, and S indicates the first sound signal played by the sound source device.

In step 403, spatial distribution information is obtained, wherein the spatial distribution information is used to indicate a spatial distribution relationship between the at least two microphones, that is, to indicate a spatial distribution relationship between respective microphones in a microphone array if the sound collecting device comprise the microphone array.

Optionally, the control device can obtain spatial distribution information of at least two microphones according to a relative positional relationship between the at least two microphones. For example, an array structure and an array size of the microphone array of a microphone array in the sound collecting device can be stored in the control device in advance, and the array structure can comprise a relative direction between the respective microphones in the array, and the control device can obtain the spatial distribution information by combining the array structure and the array size. Alternatively, the control device can further obtain the array structure and the array size of the microphone array from other devices. For example, the control device can obtain the array structure and the array size of the microphone array from a server or from the sound collecting device.

In a possible aspect, when obtaining the spatial distribution information of the microphone array of the sound collecting device, the control device can first construct a spatial coordinate system of the microphone array, that is, construct a spatial coordinate system comprising at least two microphones; and then obtain the coordinates of each of the at least two microphones in the spatial coordinate system respectively; thus obtain spatial distribution information comprising spatial coordinates of the at least two microphones in the spatial coordinate system.

Figure 6:
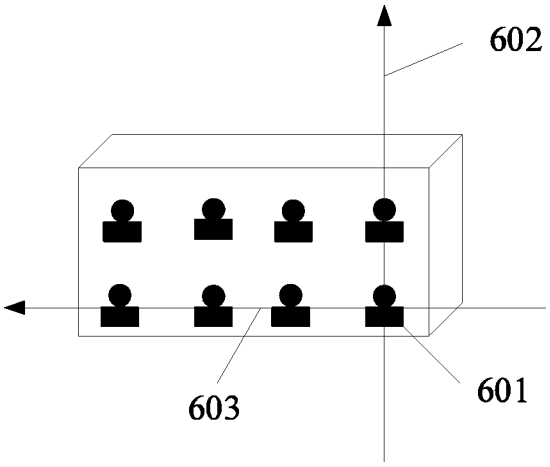
FIG. 6 is a schematic structural diagram of a spatial coordinate system constructed in relation to a sound collecting device according to an exemplary aspect of the present disclosure.

Optionally, when constructing the space coordinate system, the control device can establish a spatial coordinate system according to a pre-stored coordinate origin. For example, the developer may select one of the microphone arrays as the coordinate origin when the sound collecting device needs to construct the space coordinate, the coordinate system is established based on the microphone as the origin; or, the developer can select geometric centers of each microphone array in the microphone array as the coordinate origin. Optionally, the spatial coordinate system may be three-dimensional or two-dimensional. For example, when the microphone array of the sound collecting device is arranged in a planar form, the spatial coordinate system constructed for the sound collecting device may be two-dimensional. Please refer to FIG. 6, which is a schematic structural diagram of a spatial coordinate system constructed in relation to a sound collecting device according to an aspect of the present disclosure. As illustrated in FIG. 6, the spatial coordinate system comprises an origin of microphone 601, coordinate axis I 602, and coordinate axis II 603. Wherein, the directions of the coordinate axis I and the coordinate axis II can further be preset by the developer.

In step 404, obtaining a spatial correlation matrix of the second sound signal is obtained according to the spatial distribution information.

Figure 7:
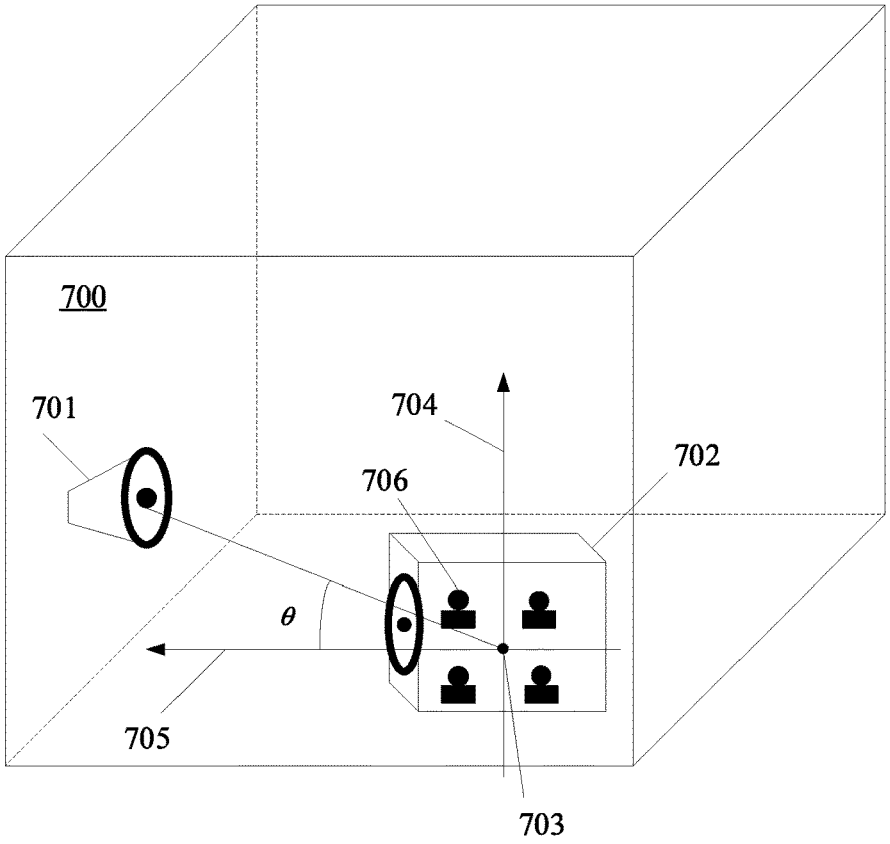
FIG. 7 is a schematic structural diagram illustrating a spatial layout for smart home devices according to an exemplary aspect of the present disclosure.

Optionally, the control device can obtain the spatial correlation matrix R(ω) of the second sound signal according to the obtained spatial distribution information. In a possible aspect, the control device can first obtain a direct angle, wherein the direct angle is an angle between a line connecting a sending source of the first sound signal and an origin of the spatial coordinate system and a first coordinate axis, and the first coordinate axis is any one of coordinate axes of the spatial coordinate system. Optionally, the first coordinate axis may be an axis specified by a developer in advance. For example, when the coordinate system constructed above is a two-dimensional Cartesian coordinate system, the developer can pre-specify that the y-axis in the constructed coordinate system is the first coordinate axis. Please refer to FIG. 7, which is a schematic structural diagram illustrating a spatial layout for smart home devices according to an aspect of the present disclosure. FIG. 7 illustrates a sound source device 701, a sound collecting device 702, an origin 703 of the coordinate system, axis I 704, axis II 705, the m-th microphone 706, and a direct angle. The control device can determine, according to the first sound signal sent by the sound source device, an angle between the sound source device and the coordinate axis II thereof through a preset algorithm, and obtain the angle as a direct angle, wherein the preset algorithm can be preset by the developer in the control device.

The control device can obtain a spatial correlation matrix of the second sound signal according to the direct angle and spatial ordinates of the at least two microphones in the spatial coordinates. wherein, the spatial correlation matrix of the second sound signal comprises a spatial correlation matrix of a direct sound signal and a spatial correlation matrix of a reverberation sound signal, wherein the direct sound signal is a sound signal that is sent by the sound source device and reaches the sound collecting device without physical reflections, and the reverberation sound signal is a sound signal that is sent by the sound source and reaches the sound collecting device through physical reflection;

Optionally, the spatial correlation dab of the direct sound signal can be calculated through the formula [4]:

$$d_{ab} = \exp\left(j\omega \frac{\|r_a - r_b\|\alpha(\theta)}{c}\right); \quad [4]$$

Where $r_a$ is the coordinate of the a-th microphone in the constructed coordinate system, $r_b$ is the coordinate of the b-th microphone in the constructed coordinate system, α(θ) is the direct angle, j is the imaginary number, and c is the propagation speed of the sound in space. The dab indicates the correlation between the direct sound signals of the i-th microphone and the j-th microphone; the control device can calculate the spatial correlation matrix of the direct sound signal according to the above formula [4]:

$$\begin{bmatrix} 1 & d_{12} & \dots & d_{1M} \\ d_{21} & d_{22} & \dots & d_{23} \\ \dots & \dots & \dots & \\ d_{M1} & d_{M2} & \dots & 1 \end{bmatrix};$$

Optionally, the spatial correlation dab of the reverberation sound signal can be calculated through the formula [5]:

$$r_{ab} = \mathrm{sinc}\left(\omega \frac{\|r_a - r_b\|}{c}\right); \quad [5]$$

$r_{ab}$ indicates the correlation between the reverberation sound signals of the i-th microphone and the j-th microphone; and the control device can calculate the spatial correlation matrix of the reverberation sound signal according to the above formula [5]:

$$\begin{bmatrix} 1 & r_{12} & \dots & r_{1M} \\ r_{21} & r_{22} & \dots & r_{23} \\ \dots & \dots & \dots & \\ r_{M1} & r_{M2} & \dots & 1 \end{bmatrix};$$

Optionally, the spatial correlation matrix of the second sound signal further comprises a frequency domain energy corresponding to the direct sound signal and a frequency domain energy corresponding to the reverberation sound signal. Taking $P_D$ (ω) for a frequency domain energy corresponding to the direct sound signal and $P_R$ (ω) for a frequency domain energy corresponding to the reverberation sound signal as an example, when the first sound signal played by the sound source device is S (ω, t), the corresponding direct component function and the corresponding reverberation component function in the second sound signal collected by the sound collecting device are $H_D$ (ω, t) and $H_R$ (ω, t), accordingly, $P_D$ (ω) and $P_R$ (ω) can be further expressed as:

$$P_D(\omega)=E[|S(\omega,t)|^2|H_D(\omega,t)|^2];$$

$$P_R(\omega)=E[|S(\omega,t)|^2|H_R(\omega,t)|^2].$$

In step 405, direct intensity information is obtained according to the spatial correlation matrix and the second sound signal.

Optionally, the control device can first construct a target equation according to the spatial correlation matrix and the second sound signal, wherein variants in the target equation are a frequency domain energy corresponding to the direct sound signal and a frequency domain energy corresponding to the reverberation sound signal.

Optionally, the spatial correlation matrix of the second sound signal obtained by the sound collecting device can be calculated through the formula [6]:

$$R(\omega)=E[X(\omega,t)X^H(\omega,t)]; \quad [6]$$

Where, $X(\omega, t)=[X^{(1)}(\omega, t), X^{(2)}(\omega, t) \dots X^{(M)}(\omega, t)]T$; that is, corresponding to an array formed by respective second sound signal received by the respective microphones, E can be expressed as mathematical expectation between X(ω, t) and $X^H$(ω, t). That is, the spatial correlation matrix of the second sound signal obtained by the sound collecting device can be expressed directly by the second sound signals collected by the respective microphones in the sound collecting device.

Optionally, the control device can calculate a corresponding R(ω) according to the formula [3]. When the first sound signal played by the sound source device is propagated to the sound collecting device under a condition of the diffusion field, the correlation between the direct sound signal and the reverberation sound signal comprised in the second sound signal collected by the sound collecting device is small and negligible. Therefore, the correlation matrix of the second sound signal collected by the sound collecting device can also be expressed approximately by a sum of the spatial correlation matrix of the direct sound signal of the second sound signal and its corresponding frequency domain energy, and the spatial correlation matrix of the reverberant sound signal of the second sound signal and its corresponding frequency domain energy. As shown in the formula [7]:

$$R(\omega) = P_D(\omega)\begin{bmatrix} 1 & d_{12} & \dots & d_{1M} \\ d_{21} & d_{22} & \dots & d_{23} \\ \dots & \dots & \dots & \\ d_{M1} & d_{M2} & \dots & 1 \end{bmatrix} + P_R(\omega)\begin{bmatrix} 1 & r_{12} & \dots & r_{1M} \\ r_{21} & r_{22} & \dots & r_{23} \\ \dots & \dots & \dots & \\ r_{M1} & r_{M2} & \dots & 1 \end{bmatrix}; \quad [7]$$

Therefore, a target equation can be established by the formula [6] and the formula [7], as shown in the formula [8]:

$$\begin{bmatrix} 1 & d_{12} & \dots & d_{1M} \\ d_{21} & d_{22} & \dots & d_{23} \\ \dots & \dots & \dots & \\ d_{M1} & d_{M2} & \dots & 1 \\ 1 & r_{12} & \dots & r_{1M} \\ r_{21} & r_{22} & \dots & r_{23} \\ \dots & \dots & \dots & \\ r_{M1} & r_{M2} & \dots & 1 \end{bmatrix}\begin{bmatrix} P_D(\omega) \\ P_R(\omega) \end{bmatrix} = \begin{bmatrix} R_{11}(\omega) \\ R_{12}(\omega) \\ \dots \\ R_{1M}(\omega) \end{bmatrix}; \quad [8]$$

The control device can calculate the pseudo-inverse from the target equation through the at least-square method, thus obtaining a matrix formed by $P_D$ (ω) and $P_R$ (ω). For example, the control device obtains a value of $P_D$ (ω) by calculating the pseudo-inverse from the target equation. And further, the control device can take the value of $P_D$ (ω) as the direct intensity information comprised in the second sound signal, so as to obtain the direct intensity information. Wherein, the direct intensity information is the frequency domain energy corresponding to the direct sound signal, and can be used to indicate intensity of the direct sound signal in the second sound signal. Optionally, when there is a need to calculate a direct component function $H_D$ (ω) in the room, the control device can also introduce the direct intensity information into $P_D(\omega)=E[|S(\omega, t)|^2 |H_D(\omega, t)|^2]$, the $H_D$ (ω, t) in the room can be calculated when the sound signal sent by the sound source device is known. Similarly, if it is required to calculate the reverberation component function $H_R$ (ω), the control device can introduce the reverberation intensity information into $P_R(\omega)=E[|S(\omega, t)|^2 |HR(\omega, t)|^2]$, thus the $H_R$ (ω, t) in the room can be calculated.

In step 406, intensity of the first sound signal is obtained.

Optionally, the control device may also obtain the signal intensity of the first sound signal, for example, the volume of the first sound, the frequency of the first sound signal, and the like. Taking the volume of the first sound as an example, when the control device controls the sound source device to play the first sound signal, the control device can control the volume of the first sound signal, and the user can increase or decrease the volume of the first sound signal.

In step 407, a signal intensity threshold is obtained according to the intensity of the first sound signal.

Optionally, a relationship table between the signal intensity of the first sound signal and the signal intensity threshold can be stored in the control device. Referring to Table 1, a correspondence between an intensity interval for the signal intensity of the first sound signal and the signal intensity threshold of the signal strength of the first sound signal are shown.

TABLE 1

| Signal intensity interval | Signal intensity threshold |
|---|---|
| Signal Intensity interval I | Signal Intensity threshold I |
| Signal Intensity interval II | Signal Intensity threshold II |
| Signal Intensity interval III | Signal Intensity threshold III |
| . . . | . . . |

When the control device obtains signal intensity of the first sound signal, the control device can obtain a signal intensity threshold through looking up the above table 1. For example, if the signal intensity of the first sound signal obtained by the control device is in the intensity interval I, the control device obtains the corresponding signal threshold I by looking up the above Table 1. Optionally, the above Table 1 can further be stored in a server, and the control device can send a query request to the server, so as to query the foregoing Table 1 through the server, thereby obtaining a signal intensity threshold corresponding to the signal intensity of the first sound signal. Optionally, the signal intensity threshold stored in the above Table 1 may be selected by the developer through actual experience and preset.

In step 408, spatial division information is obtained according to size relation of the direct signal intensity and the signal intensity threshold, wherein the spatial division information is used to indicate whether the sound source device and the sound collecting device are in a same spatial zone.

Through the obtained signal intensity threshold, the control device can judge size relation between the direct signal intensity obtained by solving the target equation and the signal intensity threshold, and determine whether the sound source device and the sound collection device are in the same space. Optionally, if the direct signal intensity obtained by solving the target equation is greater than the signal intensity threshold, it is determined that the sound source device and the sound collecting device are in the same space, otherwise, it is determined that the sound source device and the sound collecting device are not in the same space.

For example, taking that the signal intensity of the first sound signal sent by the sound source device is in the intensity interval II as an example, the control device can obtain that the signal strength threshold corresponding to the signal intensity in the signal intensity interval II is the intensity interval II through the above Table 1. And through the step mentioned above, the control device can further obtain the direct signal strength of the direct sound signal included in the second sound signal received by the sound collecting device. If the direct signal intensity obtained by the control device is greater than the signal intensity threshold II, the control device determines that the sound source device and the sound collecting device are in the same space, otherwise, the control device determines that the sound source device and the sound collecting device are not in the same space.

Figure 8:
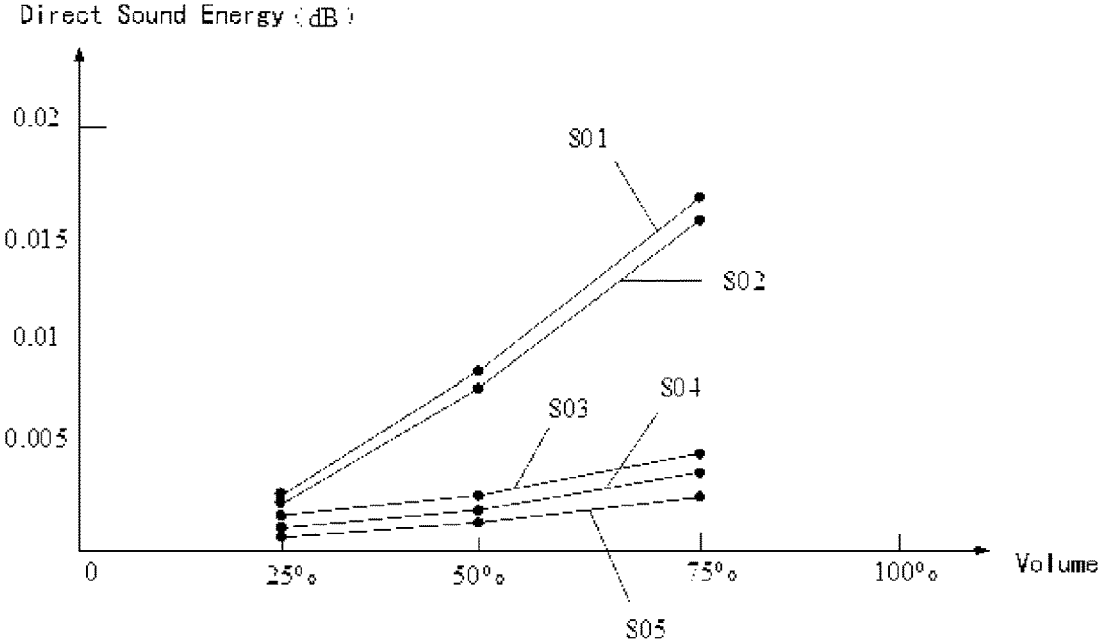
FIG. 8 is a diagram illustrating a relationship between a direct sound energy in the second sound signal and volume of a first sound signal according to an exemplary aspect of the present disclosure.

Please refer to FIG. 8, which illustrates a relationship between a direct sound energy in the second sound signal and the volume of the first sound signal according to an aspect of the present disclosure. As illustrated in FIG. 8, a first fold line 801, a second fold line 802, a third fold line 803, a fourth fold line 804, and a fifth fold line 805 are comprised. The first fold line 801 and the second fold line 802 are relationships between the direct sound energy and the volume of the first sound signal when the sound source device and the sound collecting device are in different positions in the same room; the third fold line 803, the fourth fold line 804, and the fifth The broken line 805 are relationships between the direct sound energy and the volume of the first sound signal when the sound source device and the sound collecting device are in different rooms. As can be seen from FIG. 8, the developer can select an appropriate decision threshold (i.e., a signal intensity threshold), and pre-store it in the above Table 1, it can be determined whether the sound source device and the sound collecting device are in the same room zone. For example, taking the first fold line 801 as an example, when the signal intensity of the first sound signal sent by the sound source device is 50%, the control device obtains through the steps as described above that the direct intensity of the direct sound signal comprised in the second sound signal collected by the sound collecting device is 0.006. When the control device obtains through the above Table 1 that a corresponding signal intensity threshold is 0.005 when the signal intensity is 50%, it can be determined that the sound source device and the sound collecting device are in the same space, thereby acquiring spatial division information of the sound source device and the sound collecting device.

Optionally, the control device can further store the obtained spatial division information into its own memory, or store it in the cloud. When changing the location of the sound source device or the sound collection device, the user can make correction according to the stored spatial division information, thereby guaranteeing the accuracy of spatial zone division. Optionally, after the smart home device completes the spatial zone division, when the user is in a certain space zone and uses the smart home device (for example, playing a song in the room), the smart home device can improve the playing effect in the room according to synchronized broadcast of multiple smart home devices in the space zone.

As described above, by controlling the sound source device to play the first sound signal, obtaining the sound signal collected by the sound collecting device, and completing spatial division of the sound source device and the sound collecting device according to the direct intensity information in the collected sound signal, because whether the sound source device and the sound collection device is in the same spatial zone (such as whether it is the same room) has a great influence on the intensity of the direct sound signal emitted by the sound source device, and therefore, it can be easily determined through the direct intensity information whether the two sound source devices and the sound collection device are in the same spatial zone, thereby improving the accuracy of spatial division for the smart home devices.

In addition, in the calculation process of the above-mentioned direct sound energy, since the noise signal can be mixed in the reverberant sound energy, the direct sound energy has stronger robustness with respect to other parameters (for example, RIR in the related art) in scenarios of the reverberation and diffusion field noise, and it is suitable for complex home scenes.

The following is a device aspect of the present disclosure, which may be used to implement the method aspects of the present disclosure. For the details of the apparatus aspect of the present disclosure, please refer to the method aspect of the present disclosure.

Figure 9:
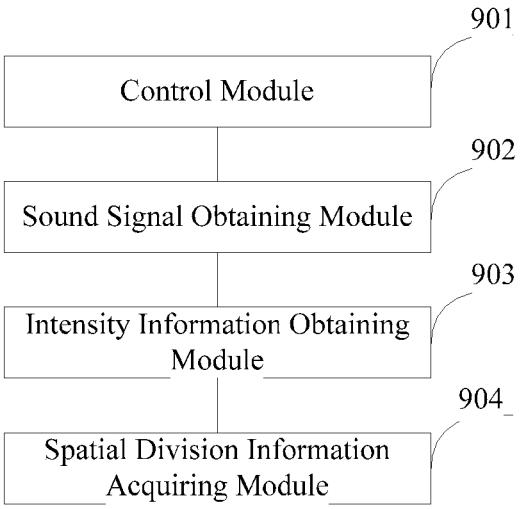
FIG. 9 is a diagram of a spatial division information acquiring apparatus according to another exemplary aspect of the present disclosure.

FIG. 9 is a diagram of a spatial division information acquiring device according to another exemplary aspect of the present disclosure. The apparatus has a function of implementing an exemplary method for the smart home device described above, and the function can be implemented by hardware or through executing corresponding software by hardware. The device may be a smart home device as described above or may be provided in a smart home device. The device 900 can comprise a control module 910, a sound signal obtaining module 920, an intensity information obtaining module 930, and a spatial division information acquiring module 940.

the controlling module, configured to control a sound source device to play a first sound signal;

the sound signal obtaining module 920, configured to obtain a second sound signal, wherein the second sound signal is a sound signal collected by a sound collecting device when the first sound signal propagates to the sound collecting device;

the intensity information obtaining module 930, configured to obtain a direct intensity information from the second sound signal, wherein the direct intensity information is used to indicate an intensity of a direct sound signal in the second sound signal, the direct sound signal is a sound signal that is sent by the sound source device and reaches the sound collecting device without physical reflection; and the spatial division information acquiring module 940, configured to acquire spatial division information according to the direct intensity information, wherein the spatial division information is used to indicate whether the sound source device and the sound collecting device are in a same spatial zone.

Optionally, the second sound signal is a sound signal collected by a microphone array in the sound collection device, and the microphone array comprises at least two microphones;

The intensity information obtaining module 930 comprises: a spatial distribution information obtaining sub-module, a correlation matrix obtaining sub-module, and an intensity information obtaining sub-module;

the spatial distribution information obtaining sub-module, configured to obtain spatial distribution information, wherein the spatial distribution information is used to indicate a spatial distribution relationship between the at least two microphones;

the correlation matrix obtaining sub-module, configured to obtain a spatial correlation matrix of the second sound signal according to the spatial distribution information; and the intensity information obtaining sub-module, configured to obtain the direct intensity information according to the spatial correlation matrix and the second sound signal.

Optionally, the spatial distribution information obtaining sub-module comprises: a coordinate system constructing unit, a coordinate obtaining unit, and a spatial distribution information obtaining unit;

the coordinate system constructing unit, configured to construct a spatial coordinate system comprising the at least two microphones;

the coordinate obtaining unit, configured to obtain respective spatial coordinates of the at least two microphones in the spatial coordinate system; and the spatial distribution information obtaining unit, configured to obtain spatial distribution information comprising respective spatial coordinates of the at least two microphones in the spatial coordinate system.

Optionally, the correlation matrix obtaining sub-module comprises a direct angle obtaining unit and a correlation matrix obtaining unit;

the direct angle obtaining unit, configured to obtain a direct angle, wherein the direct angle is an angle between a line connecting the source of the first sound signal and the origin of the spatial coordinate system and a first coordinate axis, and the first coordinate axis is any one of the coordinate axes of the spatial coordinate system; and the correlation matrix obtaining unit, configured to obtain a spatial correlation matrix of the second sound signal according to the direct angle and the respective spatial coordinates of the at least two microphones in the spatial coordinate system.

Optionally, the intensity information obtaining sub-module comprises an equation formulating unit and an intensity information obtaining unit;

the equation formulating unit, configured to formulate a target equation according to the spatial correlation matrix and the second sound signal, wherein variants in the target equation are the direct sound signal and a reverberation sound signal, and the reverberation sound signal is a sound signal that is generated by the sound source and reaches the sound collecting device through physical reflection; and the intensity information obtaining unit, configured to obtain the direct intensity information by calculating a pseudo-inverse through a least-square method.

Optionally, the spatial distribution information obtaining sub-module 930 is configured to:

acquire the spatial division information according to size relation between the direct signal intensity and a signal intensity threshold.

Optionally, the device further comprises: a size relation obtaining module and a threshold obtaining module;

the size relation obtaining module configured to obtain a signal intensity of the first sound signal before the spatial division information obtaining module obtains the spatial division information according to a size relation between the direct signal intensity and a signal intensity threshold; and the threshold obtaining module configured to obtain the signal intensity threshold according to a signal intensity of the first sound signal.

It should be noted that, when the device provided by the foregoing aspect implements its function, the division of each functional module described above is just illustrative. In actual applications, the functions can be completed by different functional modules according to actual needs. The content structure of the device is divided into different functional modules to complete all or part of the functions described above.

With regard to the device in the above aspects, the specific manner in which the respective modules perform the operations has been described in detail in the aspect relating to the method, and will not be elaborated in detail herein.

Aspects of the present disclosure provide a spatial division information acquiring apparatus, which can implement the spatial division information acquiring method according to the present disclosure. The device may be a smart home device as described above or may be provided in a smart home device. The apparatus comprises: a processor, and a memory configured to store processor executable instructions; wherein the processor is configured to:

control a sound source device to play a first sound signal;

obtain a second sound signal, wherein the second sound signal is a sound signal collected by the sound collecting device when the first sound signal is propagated to the sound collecting device;

obtain direct intensity information according to the second sound signal, wherein the direct intensity information is used to indicate an intensity of a direct sound signal in the second sound signal; the direct sound signal is a sound signal that is generated by the sound source device and is and reaches the sound collecting device without physical reflection; and obtain spatial division information according to the direct intensity information, wherein the spatial division information is used to indicate whether the sound source device and the sound collecting device are in a same spatial zone.

Optionally, when the second sound signal is a sound signal collected by a microphone array in the sound collection device, and the microphone array comprises at least two microphones; that the processor is configured to obtain the direct intensity information according to the second sound signal comprises:

obtain spatial distribution information, wherein the spatial distribution information is used to indicate a spatial distribution relationship between the at least two microphones;

obtain a spatial correlation matrix of the second sound signal according to the spatial distribution information; and obtain the direct intensity information according to the spatial correlation matrix and the second sound signal.

Optionally, that the processor is configured to obtain spatial distribution information comprises: the processor is configured to:

construct a spatial coordinate system comprising the at least two microphones;

obtain respective spatial coordinates of the at least two microphones in the spatial coordinate system; and obtain the spatial distribution information comprising respective spatial coordinates of the at least two microphones in the spatial coordinate system.

Optionally, when the processor is configured to obtain the spatial correlation matrix of the second sound signal according to the spatial distribution information, the processor is configured to: Obtain a direct angle, wherein the direct angle is an angle between a line connecting the source of the first sound signal and an origin of the spatial coordinate system and a first coordinate axis, and the first coordinate axis is any one of the coordinate axes of the spatial coordinate system; and obtain a spatial correlation matrix of the second sound signal according to the direct angle and the coordinates of the at least two microphones in the spatial coordinate system respectively.

Optionally, when the processor is configured to obtain the direct intensity information according to the spatial correlation matrix and the second sound signal, the processor is configured to:

formulate a target equation according to the spatial correlation matrix and the second sound signal, wherein variants in the target equation are the direct sound signal and a reverberation sound signal, and the reverberation sound signal is a sound signal that is generated by the sound source and reaches the sound collecting device through physical reflection; and obtain the direct intensity information through calculating a pseudo-inverse by a least-square method.

Optionally, when the processor is configured to acquire the spatial division information according to the direct intensity information, the processor is configured to:

acquire the spatial division information according to size relation between the direct signal intensity and a signal intensity threshold.

Optionally, before the processor is configured to acquire the spatial division information according to the size relation between the direct signal intensity and a signal intensity threshold, the processor is further configured to:

obtain a signal intensity of the first sound signal; and obtain a signal intensity threshold according to the signal intensity of the first sound signal.

The foregoing provides an introduction to the solution provided by the aspect of the present disclosure from the perspective of the interaction of the smart home device. It can be understood that in order to implement the above functions, the smart home device comprises corresponding hardware structures and/or software modules for performing various functions. The aspects of the present disclosure can be implemented in hardware or a combination of hardware and computer software in combination with the units and algorithm steps of the various examples described in the aspects disclosed in the present disclosure. Whether a function is implemented in a manner of hardware or computer software to drive hardware depends on the specific application and design constraints of the solution. A person skilled in the art can use different manners to implement the described functions for each specific application, but such implementation should not be considered to be beyond the scope of the technical solutions of the aspects of the present disclosure.

Figure 10:
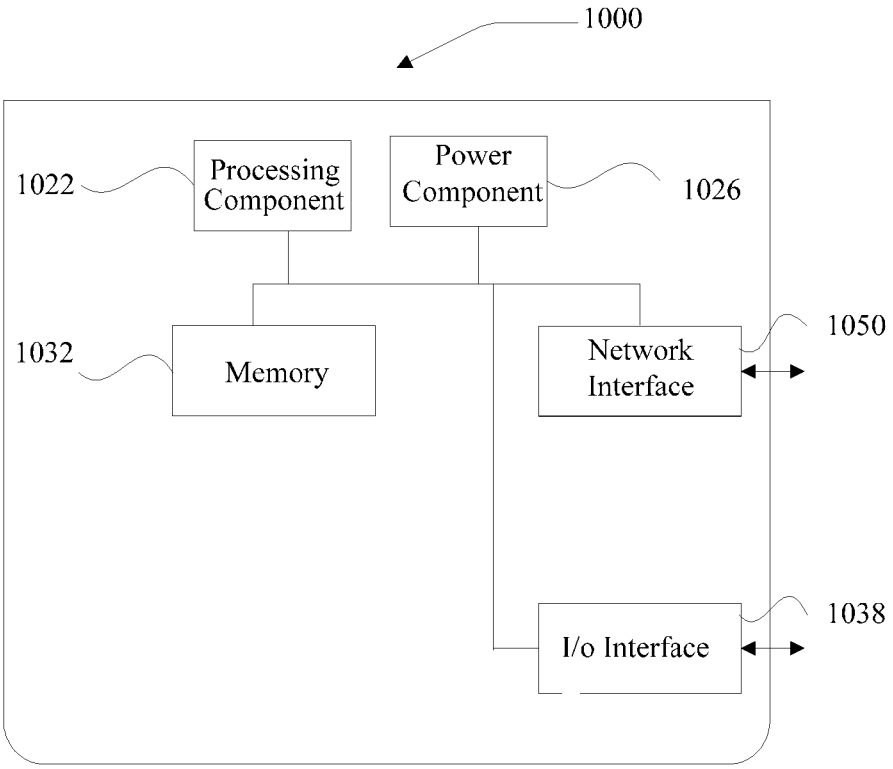
FIG. 10 is a block diagram of an apparatus for smart home devices illustrated according to one exemplary aspect of the present disclosure.

FIG. 10 is a block diagram of an apparatus for smart home devices illustrated according to one exemplary aspect of the present disclosure. For example, an apparatus 1000 can be provided as the smart home devices involved in the above aspects. Referring to FIG. 10, the apparatus 1000 comprises a processing component 1022, which further comprises one or more processors, and memory resources represented by a memory 1032 for storing instructions executable by the processing component 1022, such as an application. The application stored in the memory 1032 can comprise one or more modules each corresponding to a set of instructions. Additionally, the processing component 1022 is configured to execute instructions to perform all or some steps executed by the smart home device in the spatial division information acquiring method described above.

The apparatus 1000 can further comprise a power component 1026 configured to perform power management for the apparatus 1000, a wired or wireless network interface 1050 configured to connect the apparatus 1000 to a network, and an input/output (I/O) interface 1038. The apparatus 1000 can be operated based on an operating system stored in the memory 1032, such as Windows Server™, Mac OS X™, Unix™, Linux™, FreeBSD™ or the like.

Aspects of the present disclosure further comprises a non-transitory computer readable medium having a computer program stored thereon is provided, when the computer program executed by the processor of the smart home device processor, the computer program implements the spatial division information acquiring method as described above.

It should be understood that the term "a plurality" or "multiple" as referred to herein means two or more. When the term "and/or" is used to describe an associated relationship between associated objects, it means that there are three relationships. For example, A and/or B, which may indicate that there are three cases where A exists alone, A and B exist at the same time, and B exists alone. The character "/" generally indicates that the contextual objects have relationship of "or".

It is noted that the various modules, sub-modules, units, and components in the present disclosure can be implemented using any suitable technology. For example, a module may be implemented using circuitry, such as an integrated circuit (IC). As another example, a module may be implemented as a processing circuit executing software instructions.

Other aspects of the disclosure will be apparent to those skilled in the art from consideration of the specification and practice of the disclosure disclosed here. This application is intended to cover any variations, uses, or adaptations of the disclosure following the general principles thereof and including such departures from the present disclosure as come within known or customary practice in the art. It is intended that the specification and examples be considered as illustrative only, with a true scope and spirit of the disclosure being indicated by the following claims.

It will be appreciated that the present disclosure is not limited to the exact construction that has been described above and illustrated in the accompanying drawings, and that various modifications and changes can be made without departing from the scope thereof. It is intended that the scope of the disclosure only be limited by the appended claims.

What is claimed is:

1. A method for acquiring spatial division information, the method comprising:

controlling a sound source device to play a first sound signal;

obtaining a second sound signal that is a sound signal collected by a sound collecting device when the first sound signal is propagated to the sound collecting device;

obtaining direct intensity information based on the second sound signal, wherein the direct intensity information indicates an intensity of a direct sound signal in the second sound signal, wherein the direct sound signal is a sound signal that is generated by the sound source device and reaches the sound collecting device without physical reflection; and obtaining spatial division information based on the direct intensity information, wherein the spatial division information indicates whether the sound source device and the sound collecting device are in a same spatial zone, wherein the second sound signal is a sound signal collected by a microphone array in the sound collection device, wherein the microphone array includes at least two microphones, and wherein obtaining the direct intensity information based on the second sound signal includes:

obtaining spatial distribution information that indicates a spatial distribution relationship between the at least two microphones;

obtaining a spatial correlation matrix of the second sound signal based on the spatial distribution information; and obtaining the direct intensity information based on the spatial correlation matrix and the second sound signal, wherein the spatial correlation matrix of the second sound signal comprises a spatial correlation matrix of a direct sound signal and a spatial correlation matrix of a reverberation sound signal.

2. The method according to claim 1, wherein obtaining the spatial distribution information includes:

constructing a spatial coordinate system including the at least two microphones;

obtaining respective spatial coordinates of the at least two microphones in the spatial coordinate system; and obtaining the spatial distribution information including respective spatial coordinates of the at least two microphones in the spatial coordinate system.

3. The method according to claim 2, wherein obtaining the spatial correlation matrix of the second sound signal based on the spatial distribution information includes:

obtaining a direct angle that is an angle between a line connecting the source of the first sound signal and an origin of the spatial coordinate system and a first coordinate axis that is any one of the coordinate axes of the spatial coordinate system; and obtaining a spatial correlation matrix of the second sound signal based on the direct angle and the coordinates of the at least two microphones in the spatial coordinate system respectively.

4. The method according to claim 1, wherein Obtaining the direct intensity information based on the spatial correlation matrix and the second sound signal includes:

formulating a target equation based on the spatial correlation matrix and the second sound signal, wherein variants in the target equation are the direct sound signal and a reverberation sound signal that is a sound signal that is generated by the sound source and reaches the sound collecting device through physical reflection; and obtaining the direct intensity information through calculating a pseudo-inverse by a least-square method.

5. The method according to claim 1, wherein obtaining the spatial distribution information based on the direct intensity information includes:

acquiring the spatial division information based on size relation between the direct signal intensity and a signal intensity threshold.

6. The method according to claim 5, wherein, before acquiring the spatial division information based on the size relation between the direct signal intensity and the signal intensity threshold, the method further comprises:

obtaining a signal intensity of the first sound signal; and obtaining a signal intensity threshold based on the signal intensity of the first sound signal.

7. The method according to claim 1, wherein obtaining the spatial distribution information based on the direct intensity information includes:

acquiring the spatial division information based on size relation between the direct signal intensity and a signal intensity threshold.

8. The method according to claim 2, wherein obtaining the spatial distribution information based on the direct intensity information includes:

acquiring the spatial division information based on size relation between the direct signal intensity and a signal intensity threshold.

9. The method according to claim 3, wherein obtaining the spatial distribution information based on the direct intensity information includes:

acquiring the spatial division information based on size relation between the direct signal intensity and a signal intensity threshold.

10. An apparatus for acquiring spatial division information, the apparatus comprising:

a processor; and a memory configured to store processor executable instructions, wherein the processor is configured to:

control a sound source device to play a first sound signal;

obtain a second sound signal that is a sound signal collected by a sound collecting device when the first sound signal is propagated to the sound collecting device;

obtain direct intensity information based on the second sound signal, wherein the direct intensity information indicates an intensity of a direct sound signal in the second sound signal, wherein the direct sound signal is a sound signal that is generated by the sound source device and reaches the sound collecting device without physical reflection; and obtain spatial division information based on the direct intensity information, wherein the spatial division information indicates whether the sound source device and the sound collecting device are in a same spatial zone, wherein when obtaining the direct intensity information based on the second sound signal, the processor is further configured to:

obtain spatial distribution information that indicates a spatial distribution relationship between at least two microphones that are included in the sound collecting device;

obtain a spatial correlation matrix of the second sound signal based on the spatial distribution information, wherein the second sound signal is a sound signal collected by a microphone array in the sound collection device; and obtain the direct intensity information based on the spatial correlation matrix and the second sound signal, wherein the spatial correlation matrix of the second sound signal comprises a spatial correlation matrix of a direct sound signal and a spatial correlation matrix of a reverberation sound signal.

11. The apparatus according to claim 10, wherein when obtaining the spatial distribution information, the processor is further configured to:

construct a spatial coordinate system including the at least two microphones;

obtain respective spatial coordinates of the at least two microphones in the spatial coordinate system; and obtain the spatial distribution information including respective spatial coordinates of the at least two microphones in the spatial coordinate system.

12. The apparatus according to claim 11, wherein when obtaining the spatial correlation matrix of the second sound signal based on the spatial distribution information, the processor is further configured to:

obtain a direct angle that is an angle between a line connecting the source of the first sound signal and an origin of the spatial coordinate system and a first coordinate axis that is any one of the coordinate axes of the spatial coordinate system; and obtain a spatial correlation matrix of the second sound signal based on the direct angle and the coordinates of the at least two microphones in the spatial coordinate system respectively.

13. The apparatus according to claim 10, wherein when obtaining the direct intensity information based on the spatial correlation matrix and the second sound signal, the processor is further configured to:

formulate a target equation based on the spatial correlation matrix and the second sound signal, wherein variants in the target equation are the direct sound signal and a reverberation sound signal that is a sound signal that is generated by the sound source and reaches the sound collecting device through physical reflection; and obtain the direct intensity information through calculating a pseudo-inverse by a least-square method.

14. The apparatus according to claim 10, wherein when obtaining the spatial distribution information based on the direct intensity information, the processor is further configured to:

acquire the spatial division information based on size relation between the direct signal intensity and a signal intensity threshold.

15. The apparatus according to claim 14, wherein, before acquiring the spatial division information based on the size relation between the direct signal intensity and the signal intensity threshold, the process is further configured to:

obtain a signal intensity of the first sound signal; and obtain a signal intensity threshold based on the signal intensity of the first sound signal.

16. The apparatus according to claim 10, wherein when obtaining the spatial distribution information based on the direct intensity information, the processor is further configured to:

acquire the spatial division information based on size relation between the direct signal intensity and a signal intensity threshold.

17. The apparatus according to claim 11, wherein when obtaining the spatial distribution information based on the direct intensity information, the processor is further configured to:

acquire the spatial division information based on size relation between the direct signal intensity and a signal intensity threshold.

18. The apparatus according to claim 12, wherein when obtaining the spatial distribution information based on the direct intensity information, the processor is further configured to:

acquire the spatial division information based on size relation between the direct signal intensity and a signal intensity threshold.

* * * * *